US008241019B2

(12) United States Patent
Kueck et al.

(10) Patent No.: US 8,241,019 B2
(45) Date of Patent: Aug. 14, 2012

(54) PUMP ELEMENT AND PUMP HAVING SUCH A PUMP ELEMENT

(75) Inventors: Heinz Kueck, Stuttgart (DE); Daniel Benz, Luetenbach (DE); Frank Wolter, Leonberg (DE)

(73) Assignee: Hahn-Schickard-Gesellschaft Fuer Angewandte Forschung e.V., Villingen-Schwenningen (DE)

( * ) Notice: Subject to any disclaimer, the term of this patent is extended or adjusted under 35 U.S.C. 154(b) by 745 days.

(21) Appl. No.: 12/303,979

(22) PCT Filed: Mar. 27, 2007

(86) PCT No.: PCT/EP2007/002689

§ 371 (c)(1),
(2), (4) Date: Jan. 14, 2009

(87) PCT Pub. No.: WO2008/003359

PCT Pub. Date: Jan. 10, 2008

(65) Prior Publication Data

US 2009/0180905 A1 Jul. 16, 2009

(30) Foreign Application Priority Data

Jul. 5, 2006 (DE) ..... 20 2006 010 726 U

(51) Int. Cl.
*F04B 7/04* (2006.01)
*F04B 39/10* (2006.01)

(52) U.S. Cl. ..... 417/490; 417/498

(58) Field of Classification Search ..... 417/321, 417/310.1, 423.1, 423.3, 510, 415, 490, 498
See application file for complete search history.

(56) References Cited

U.S. PATENT DOCUMENTS 3,380,387 A 4/1968 Kofink
(Continued)

FOREIGN PATENT DOCUMENTS

AU 446929 4/1974
(Continued)

OTHER PUBLICATIONS

Martinez et al.: "A Novel Concept of Electroactive Pump for Medical Circulatory Support," Acutator 2006; 10th International Conference on New Actuators; Conference Proceedings; Jun. 14-16, 2006; pp. 976-979.

(Continued)

*Primary Examiner* — Anh Mai
*Assistant Examiner* — Zachary J Snyder
(74) *Attorney, Agent, or Firm* — Keating & Bennett, LLP

(57) ABSTRACT

A pump element includes a pump element housing defining a pump chamber having an inlet and an outlet, and at least a first movable element movable in the pump chamber between a first and a second position. During a movement of the first movable element in the direction from the first to the second position, a flow resistance of a flow path from the first movable element through the inlet is larger than a flow resistance of a flow path between the pump element housing and the first movable element. During a movement of the first movable element in the direction from the second position to the first position, a flow resistance of a flow path from the first movable element through the outlet is smaller than a flow resistance of the flow path between the pump element housing and the first movable element. Thus, during a reciprocating movement of the first movable element between the first and the second position, a net flow through the outlet takes place.

15 Claims, 4 Drawing Sheets

U.S. PATENT DOCUMENTS

| | | | | |
|---|---|---|---|---|
| 3,841,798 | A | 10/1974 | Rehfeld | |
| 4,599,054 | A | 7/1986 | Spears | |
| 4,944,661 | A | 7/1990 | Mayer | |
| 5,346,369 | A | 9/1994 | Miller, Jr. | |
| 2003/0136189 | A1 | 7/2003 | Lauman et al. | |
| 2004/0065304 | A1 * | 4/2004 | Xi et al. | 123/497 |
| 2006/0144244 | A1 | 7/2006 | Girard et al. | |

FOREIGN PATENT DOCUMENTS

| | | | |
|---|---|---|---|
| EP | 0 103 536 | A1 | 3/1984 |
| JP | 54-127609 | U | 9/1979 |
| JP | 57-114182 | U | 7/1982 |
| JP | 03-037288 | U | 4/1991 |
| JP | 08-114178 | A | 5/1996 |
| JP | 2000-199477 | A | 7/2000 |
| JP | 2000-220570 | A | 8/2000 |
| JP | 2005-054721 | A | 3/2005 |
| JP | 2006-503598 | A | 2/2006 |
| SU | 1732820 | A3 | 5/1992 |
| WO | 2004/040135 | A1 | 5/2004 |
| WO | 2005/079361 | A2 | 9/2005 |

OTHER PUBLICATIONS

English translation of Official Communication issued in corresponding Russian Patent Application No. 2009103763, issued on Mar. 2, 2010.

Official Communication issued in International Patent Application No. PCT/EP2007/002689, mailed on Sep. 27, 2007.

Official Communication issued in International Patent Application No. PCT/EP2007/002689, mailed on Jun. 10, 2008.

Official Communication issued in corresponding Japanese Patent Application No. 2009-516917, mailed on Aug. 16, 2011.

* cited by examiner

PUMP ELEMENT AND PUMP HAVING SUCH A PUMP ELEMENT

BACKGROUND OF THE INVENTION

The present invention relates to a pump element and a pump having such a pump element. Conventionally, a plurality of pumps is known that can be used for driving fluids. The sizes of the pumps vary from micro technically produced up to very large pumps having high pumping power, for example in power plants.

Conventional pumps are complex structures including the fluidic structure, the driving and possibly a control or regulating means. The high production costs, which almost preclude the application of such pumps for single use, are a disadvantage of the high complexity of the known pumps. Further, in complex structures, the effort for obtaining high reliability is also increased.

In many pumps, auxiliary substances, such as lubricants or greases, are necessitated for driving or operating, respectively, the pump, which could also come in contact with the fluid. This prohibits usage in medical or process-technological applications.

Thus, there is a need for a pump element and a pump that can also be used, among other things, in medical and process-technological applications and consumer applications for single use.

SUMMARY

According to an embodiment, a pump element may have a pump element housing defining a pump chamber; an inlet into the pump chamber; an outlet from the pump chamber; and a first movable element movable in the pump chamber between a first and a second position, wherein during a movement of the first movable element in the direction from the first to the second position, a flow resistance of a flow path from the first movable element through the inlet is higher than a flow resistance of a flow path between the pump element housing and the first movable element, and wherein during a movement of the first movable element in the direction from the second position towards the first position, a flow resistance of a flow path from the first movable element through the outlet is smaller than a flow resistance of the flow path between the pump element housing and the first movable element, so that a net flow through the outlet takes place during a reciprocating movement of the first movable element between the first and the second position, wherein the first movable element closes the outlet when the same is in the first position.

Thus, in embodiments of the present invention, during the movement of the movable element in the direction from the first to the second position, more fluid is pressed past the first movable element in the direction towards the outlet of the pump chamber than is leaving the pump chamber through the inlet. In embodiments of the present invention, the inlet can be closed during the movement of the first movable element in the direction from the first to the second position, or at least during a large part of this movement, for example by a second movable element.

Additionally, in embodiments of the invention, due to the defined flow resistances, more fluid is ejected through the outlet during a movement of the first movable element in the direction from the second position to the first position than is moved past the movable element in the direction towards the inlet. Thus, by a reciprocating movement of the movable element, a net flow through the outlet can take place.

According to another embodiment, a pump element may have a pump element housing defining a pump chamber having an inlet and an outlet; a first movable element movable in the pump chamber between a first position and a second position, wherein the outlet is closed when the first movable element is in the first position; a second movable element movable in the pump chamber between a third and a fourth position; a first spring biasing the first movable element to the first position; and a second spring biasing the second movable element to the third position, wherein a net flow through the outlet takes place during a reciprocating movement of the first movable element between the first and the second position and the second movable element between the third and the fourth position.

According to another embodiment, a pump may have a respective pump element and a driving unit, which is implemented to drive the first movable element from the first into the second position and/or to drive the second movable element from the third into the fourth position.

According to another embodiment, a method for adjusting the discharge rate of a respective pump may have the steps of adjusting a frequency at which the first and, if present, the second movable element are moved back and forth; adjusting the stroke of the movement of the first movable element between the first and the second position; adjusting the flow resistance of the flow path between the first movable element and the pump element housing; and changing a spring bias biasing the first movable element to the first position and/or a spring bias biasing the second movable element to the third position.

Another embodiment may have a method for operating a respective pump wherein during a reciprocating movement of the movable element a known amount of fluid is discharged from the outlet, wherein a number of reciprocating movements of the first movable element is counted for outputting a defined amount of dosage through the outlet.

Embodiments of the present invention can relate to miniature pumps or micro pumps where an amount of fluid pumped per pump stroke is in the micro liter range, nano liter range or pico liter range. Embodiments of the invention can relate to pumps for fluids, such as infusions, lubricants, foodstuffs or cleaning fluids, wherein pump element and driving unit can be designed separately. The pump element can be produced cost effectively, for example by plastic injection molding, and can be disposed of after use. The driving unit can be reused, wherein, in embodiments of the present invention, the driving unit does not come in contact with the fluid to be pumped. In embodiments of the invention a pumped amount of fluid can be determined directly from the number of pump strokes. Further, in embodiments of the invention, the pump element can have an integrated lock valve for controlling the fluid flow. In embodiments of the invention, the integrated lock valve can lock a fluid flow through the pump element in the non-operated state of the pump element.

Embodiments of the inventive pump can be used for a plurality of applications, particularly in the fields of medicine, process technology, and research. One example is automatic medication dosing means in human medicine.

In embodiments of the present invention, during the movement of the first movable element in the direction from the first to the second position, a fluid transport takes place from an area arranged on the side of the first movable element facing away from the outlet past the movable element to an area arranged on a side of the first movable element facing the outlet. During this movement, the inlet can be closed in order to realize reflow through the inlet that is as low as possible and suction through the outlet associated therewith. During the movement of the first movable element in the direction from the first to the second position, a fluid, for example a liquid or a gas can be transported past the first movable element.

In embodiments of the present invention, during the movement of the first movable element in the direction from the second position to the first position, the fluid to be pumped is displaced by the first movable element and output through the outlet. At the same time, fluid is sucked through the inlet. This moving phase can thus also be referred to as transport phase. By alternating transport phases and pump phases, a net flow in the direction from the inlet to the outlet can take place.

In embodiments of the present invention, the pump element can be implemented such that during operation, the second movable element is moved faster from the third to the fourth position than the first element is moved from the first to the second position. In embodiments of the present invention, the second movable element closes the inlet in the fourth position. Thus, during the phase where fluid to be pumped is transported past the first movable element, a reflow through the inlet can be reduced or minimized. In embodiments of the present invention, the second spring can have a lower spring constant than the first spring in order to effect the faster movement of the second movable element. In embodiments of the invention, separate driving units can be provided for the first movable element and the second movable element. A driving unit for the second movable element can effect a movement of the same from the third position to the fourth position, before a driving unit effects the movement of the first movable element from the first to the second position. In alternative embodiments, the driving unit and/or the first movable element and the second movable element can be implemented such that a larger force is applied to the second movable element, so that the same is moved faster to the fourth position than the first movable element is moved to the second position.

Embodiments of the present invention allow that the fluidic structure of the pump element and its drive are made up separate from each other. The actual pump element can consist of a few elements and can be produced in a cost effective manner, for example by plastic injection molding. Embodiments of the present invention enable the pump element to be disposed of after use, so that single uses are possible in an economic manner. In embodiments of the invention, the more cost-intensive driving unit that can comprise a control or regulation means, can be used for several pump elements or across several pump element life cycles. Thereby, in critical applications, such as medical technology or food technology, the pump element, which means the fluidic element coming in contact with the fluid to be pumped, can be exchanged after every application without having to replace the more cost-intensive driving unit.

In embodiments of the present invention, a pump function can be taken over by two metallic movable elements, such as balls or pistons that are held in a defined position by two springs in a pump chamber, which can also be referred to as channel. In a first or third position, respectively, the first movable element closes the outlet from the pump chamber, while the second movable element can clear the inlet to the pump chamber that can be connected to a reservoir for a fluid to be pumped, wherein the pump chamber is filled with fluid through the inlet. In embodiments of the present invention, the movable elements can be moved by a magnetic force against the spring force into the second or fourth position, respectively, by one or several coils integrated in the driving unit. Thereby, in embodiments, the second movable element closes the inlet at first, while the movable element clears the outlet and the fluid, liquid or gas, contained in the pump chamber is pressed past the first movable element (transport phase). After turning off the magnetic force, the spring presses the first movable element back, whereby fluid in front of the first movable element is at least partly transported through the back outlet. Thereby, a leakage flow occurs through the gap between the movable element and the pressure chamber wall, through which a certain amount of liquid can flow back during the pumping movement. The amount of the leakage flow is determined by the gap width between the first movable element and the pump chamber wall, i.e. the flow resistance of the flow path between the first movable element and the pump chamber wall. In embodiments of the invention, the first movable element seals the outlet again at the end of the pumping movement. In embodiments of the invention, the second movable element opens the inlet approximately at the same time, whereby the housing is filled again. The dosed volume flow can be controlled by the number and speed of the pump strokes. Above that, between the pump cycles, the pump can lock the fluid flow without leakage.

In embodiments of the present invention, pump elements with different throughputs can be realized by the pump design. For example, the cross section of the fluidic structure, i.e. the pump chamber channel of the same, the length of the pump stroke and the size of the gap between movable element and channel wall can be adjusted in order to adjust the amount of fluid discharged per pump stroke. Thus, it is, for example, possible to cover a large range of discharge volumes with one or only a few different driving units. The same driving unit can drive, for example, pump elements with different throughputs.

Further, advantageously, embodiments of the present invention allow that a pump can be implemented with a monitoring unit with only little additional effort, which can monitor the position of the pump, i.e. which can determine the position of the first movable element and/or, if present, the position of the second movable element. In embodiments of the invention, the driving unit can have a driving coil, wherein a further measuring coil can be integrated in the driving unit. By generating a superposed magnetic alternating field by the driving coil, voltage can be induced in the additional measuring coil. The induced voltage depends on the position of the movable element(s), whose material has a permeability. Thus, by an appropriate measuring means, the position of the pump element can be determined, which allows monitoring of the function of the pump.

BRIEF DESCRIPTION OF THE DRAWINGS

Embodiments of the present invention will be detailed subsequently referring to the appended drawings, in which.

DETAILED DESCRIPTION OF THE INVENTION

In the different views, the same reference numbers are used for equal or functionally equal elements, wherein a repeated description of respective elements is omitted.

Figure 1A:
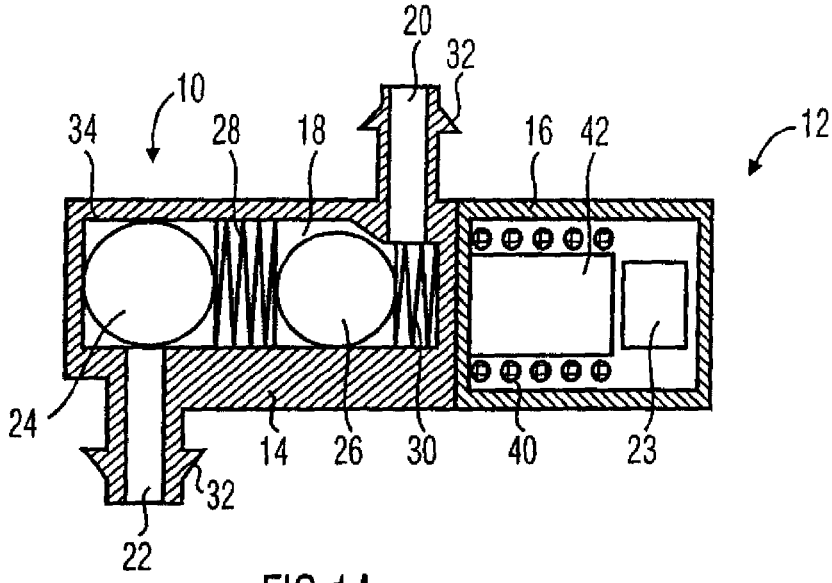
FIGS. 1*a* and 1*b* are schematic sectional views of an embodiment of an inventive pump.
Figure 1B:
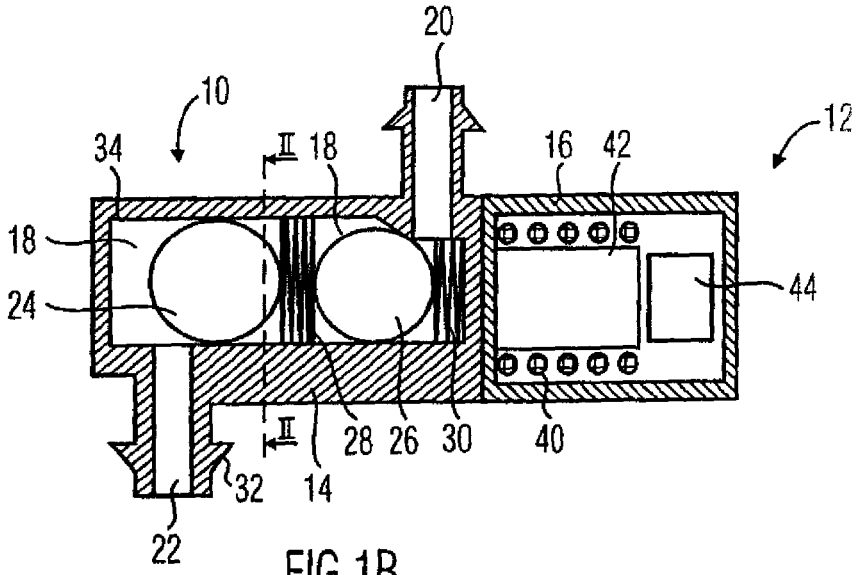

FIG. 1*a* shows a sectional view of an embodiment of an inventive pump in an idle state, and FIG. 1*b* shows a pump in an operated state. The pump comprises a pump element 10 and a driving unit 12. The pump element 10 comprises a pump element housing 14 and the driving unit 12 comprises a driving unit housing 16. The pump element housing 14 and the driving unit housing 16 are build as separate housings, such that the same can be coupled to each other and can be separated from each other. Appropriate devices, which can couple the driving unit housing 16 and the pump element housing 14 in a reversible manner, are obvious for persons skilled in the art, and comprise, for example, snap-on connections, screw connections, hooks, clamps, Velcro fasteners and the same and need no further explanation.

The pump element housing 14 defines a pump chamber 18, an inlet 20 and an outlet 22. The pump element housing 14 can be realized, for example, in a cost effective manner by plastic injection molding, wherein the inlet 20 and the outlet 22 can be injected. A first ball 24 representing the first movable element and a second ball 26 representing the second movable element are in the pump chamber 18. A spring 28 is between the balls 24 and 26. A second spring 30 is between the second ball 26 and the pump element housing 14. The first spring 28 and the second spring 30 bias the first ball 24 and the second ball 26 to the positions shown in FIG. 1*a*. In the shown embodiment, the springs 28 and 30 are formed as spiral springs.

In the shown embodiment, the spring assembly positions the first ball 24 without external force such that the outlet 22 is closed, wherein the first spring 28 holds the first ball 24 in this position. The spring assembly positions the second ball 26 such that the inlet 20 is opened and the pump chamber 18 in the housing 14 is filled with fluid.

The inlet 20 can be connected to a fluid reservoir (not shown) via appropriate fluid lines, while the outlet 22 can be connected to a target region (not shown) via appropriate fluid lines. For this purpose, the inlet 20 and the outlet 22, can have, for example, luer connecting structures 32.

For increasing the sealing action of the first ball 24 on the outlet 22, further, a further spring 34, for example in the shape of a leaf spring, can be provided, which presses the first ball 24 on a sealing seat formed on the outlet 22. In the shown embodiment, the leaf spring 34 generates a force perpendicular to the force generated by the springs 28 and 30. The balls 12 can be formed, for example, as metallic balls, while the springs can be formed, for example, from non-magnetic non-ferrous metal.

The driving unit 12 comprises one or several driving coils 40 as electromagnetic drive for the metallic ball 24, which surround a ferromagnetic core 42. For increasing the magnetic force on the movable elements, the ferromagnetic core 42 can also have the shape of a yoke with appropriate pole shoes at the positions of the movable elements, which significantly improves the magnetic reflow, as will be discussed below in more detail with reference to FIGS. 5 and 7. Further, the driving unit 12 comprises a control means 44, which is coupled to the driving coils 40 to selectively and cyclically impressing current through the one or several coils 40, for generating an electromagnetic force acting on the metallic balls 24 and 26.

Due to the generated electromagnetic force, the second ball 26 is moved in the direction towards the inlet 20, against the force of the second spring 30, so that the inlet 20 is sealed, as shown in FIG. 1*b*. By increasing the current strength through the driving coil or the driving coils 40, respectively, the magnetic force on the ball 24 can be increased, as long as the ferromagnetic core 42, and, if present, a yoke, are not yet in the magnetic saturation. For moving the second ball 26 from the resting position shown in FIG. 1*a* to the sealing position shown in FIG. 1*b*, the same has to be moved by a distance $s_2$. This necessitates a magnetic force $F_{magnet}(s_2)$. The bias of the springs $F_{vor}$ can be adjusted such that the first ball 24 does not move until the second ball 26 has sealed the inlet 20. In order to finally bring the first ball 24 into the position shown in FIG. 1*b*, against the force of the first spring 28 with the spring constant $c_1$, the same has to be moved by a distance $s_1$. For overcoming the spring forces, at least a magnetic force of $$F_{magnet}(s_1)=F_{magnet}(s_2)+c_1*s_1+F_{flow}[\mathrm{N}]$$

is necessitated.

Thereby, the outlet 22 is opened and during the movement of the second ball 24 the fluid flows past the same, i.e. flows through a flow path between the first ball 24 and the pump element housing 14. The flow force $F_{flow}$ depends mainly on the gap width of the gap between the second ball 24 and the pump element housing 14 and on the velocity v, with which the first ball 24 moves.

For describing the functionality of FIGS. 1*a* and 1*b*: The spring constants and the spring biases of the springs 14 and 17 can thus be chosen such that after turning on the magnetic force, the ball 26 is moved first and seals the inlet 20 before the ball 24 moves due to the fluid and clears the outlet 22. If the magnetic force is turned of, both balls can move virtually simultaneously, because the fluid flowing in through the inlet 20 supports the spring 30. The second ball 26 can have a slightly lower diameter than the first ball 24.

Figure 2:
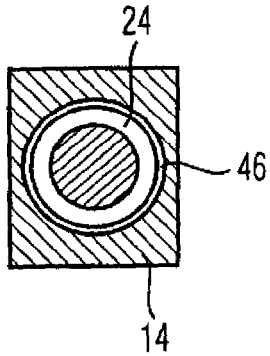
FIGS. 2 and 3 are schematic cross-sectional views of embodiments for illustrating a flow path between pump element housings and first movable elements.

FIG. 2 shows schematically a cross-sectional view along the lines II-II in FIG. 1*b*, wherein a respective circular gap 46 is visible, similar to a technical seat, which results in the flow path between the first ball 24 and the inner pump chamber wall in a pump chamber with a circular inner cross section. Thereby, the ball has a lateral clearance in the pump chamber, which results in the flow gap. The gap width of the circular gap can advantageously be significantly smaller than the diameter and can depend on the diameter of the ball. For example, depending on the diameter of the ball, the gap width can be less than 100 μm, less than 50 μm or less than 20 μm. In FIG. 2, the ball is shown in a centered manner, wherein the position can actually deviate from the shown position depending on the circumstances, which means, for example, the alignment, so that there is no gap on one side of the ball.

Figure 3:
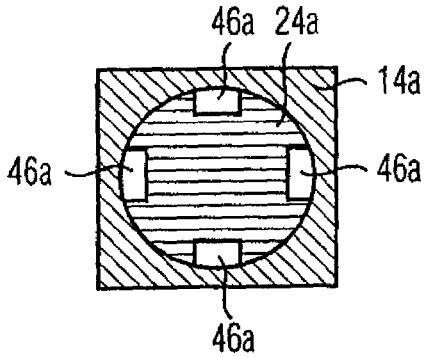

Alternatively, another inner cross section, for example, a square inner cross section, could be used. A schematic cross section view of an alternative embodiment with a pump element housing 14*a* having a round pump chamber cross section is shown in FIG. 3. A cylinder piston shaped movable element 24*a* has one or several channels 46*a*, resulting in one or several flow paths between the movable element 24*a* and the pump element housing 14*a* as shown in FIG. 3. Although four channels 46*a* are shown in FIG. 3, a different number of channels, for example only one channel, can be provided in alternative embodiments.

Referring again to FIG. 1*b*, the same shows the arrangement of the pump during action of a magnetic force of $F_{magnet} \geqq F_{magnet}(S_1)$. The control means 44 is implemented to provide the driving coil 40 with such a current that a respective magnetic force is applied to the first ball 24.

Thus, by operating the driving unit 12, a movement of the balls 24 and 26 from the positions shown in FIG. 1*a* to the positions shown in FIG. 1*b* is effected. Thereby, the ball 24 in the pump chamber 18 is moved away from the outlet 22, wherein fluid from a side of the ball 24 facing away from the outlet 22 is transported to a side of the ball facing the outlet 22, along the one or several flow paths 46 or 46*a*, respectively, as they are shown, for example, in FIGS. 2 and 3. If the magnetic force through the driving unit 12 is turned off, by turning off the current through the driving coil 40 by the control means 44, the ball 24 presses the fluid out of the pump chamber 18 through the outlet 22 due to the force of the first spring 28, whereupon then the ball 24 finally seals the outlet 22 again. During this movement of ball 24, the second ball 26 clears the inlet 20, so that new fluid can flow again into the pump chamber through the inlet 20. Thus, the balls 24 and 26 resume the positions shown in FIG. 1*a* due to the bias of springs 28 and 30. Starting from this state, the driving unit can be operated again, so that, by cyclically operating the driving unit, a defined fluid volume can be pumped, by performing a certain number of pump cycles per pump stroke with a known volume.

The pumped volume is given by the geometry, particularly the size of the ball 24, the size of the pump stroke (i.e. the distance $s_1$ of the movement of the ball 24) as well as the size of the flow gap 46 between the ball 24 and the pump element housing 14. By adjusting the geometry, the volume pumped per pump stroke can be adjusted. Based on the number of pump strokes, the discharged volume can be determined.

For the attainable dosing accuracy of the pump, it is advantageous in embodiments of the invention that the ratio between the pumped amounts of fluid, for example the amount of liquid and the amount of fluid flowing back through the gap 46 during the pumping movement of the ball 24 becomes as large as possible.

Figure 4:
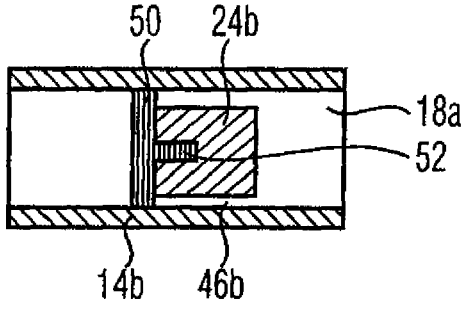
FIGS. 4 and 5 are schematic views of embodiments allowing a variable flow resistance of the flow path between a pump element housing and a first movable element.

Therefore, in the embodiments of the invention, the flow resistance of the gap 46 can be sufficiently large during the pumping movement. This can be obtained by a respective narrow gap 46 or additional measures. In this regard, FIG. 4 shows a schematic representation of a pump element housing 14*b* wherein a movable element 24*b* is disposed. The cross section of the pump chamber 18*a* formed in the pump element housing 14*b*, can, for example, be circular, wherein the movable element 24*b* can be in the shape of a cylinder piston, so that a flow gap 46*b* is formed between the inner wall of the pump element housing 14*b* and the movable element 24*b*. The movable element 24*b* has a sealing element 50, which is mounted at the same and changes a flow resistance for a fluid to be pumped between the movable element 24*b* and the channel wall of the pump chamber housing 14*b* depending on the direction of movement.

The sealing element 50 is designed in a flexible manner and is suitable for a connection to the movable element 24*b*, for example, only via a pin 52. Thus, for a passing fluid, the sealing element 50 provides a lower flow resistance during the movement of the movable element 24*b* in FIG. 4 to the right than during a movement of the movable element 24*b* in FIG. 4 to the left. In other words, during the movement to the right the sealing element provides a higher flexibility, since the same can be reflected away from the movable element 24*b*, while it is pressed against the same during the movement of the movable element 24*b* to the left. Thus, the movable element has an additional valve function.

The additional sealing element 50 can be formed from any elastic material, such as rubber, which changes its fluidically effective geometry depending on the direction of movement of the movable element 24*b* and thus allows a change of the flow resistance for generating a desired valve function.

Figure 5:
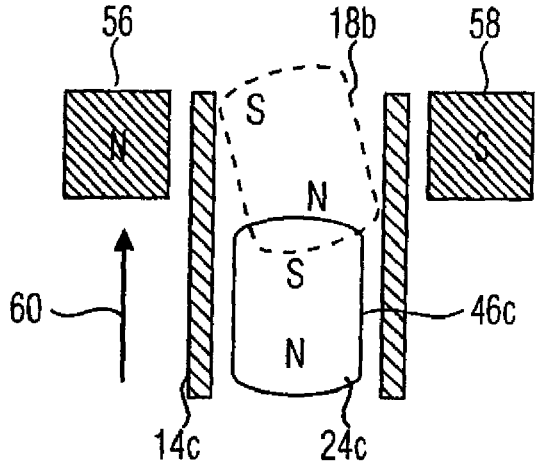

An alternative embodiment for obtaining a dynamic valve effect of a movable element is shown schematically in FIG. 5. FIG. 5 shows schematically a pump element housing 14*c* and a movable element 24*c* arranged therein. Further, FIG. 5 shows schematically pole shoes 56 and 58 of a magnetic driving unit. In the embodiment shown in FIG. 5, the movable element 24*c* is formed such that the same effects a different flow resistance of a fluidically effective gap 46*c* in dependence of its position in the flow channel, i.e. in the pump channel 18*b* formed in the pump element housing 14*c*. In the shown embodiment, this can be obtained by overlaying a translatory movement 60 of the movable element 24*c* by a rotatory movement, which increases or decreases the fluidic gap 46*c*, so that different flow resistances are effected. In the example shown in FIG. 5, the element 24*c* can be, for example, a ball flattened on two or several sides, which can rotate around its central axis. Further, the movable element 24*c* can be formed of a permanent magnetic material, so that a rotation of the movable element 24*c* takes place, when the same is moved between the pole shoes 56 and 58 by the translatory movement 60, as it is indicated by dotted lines in FIG. 5. The cross section of the gap 46*c* can decrease during the pumping movement of the movable element 46*c* in the direction towards the pump outlet, and can increase during the charging movement in the direction away from the pump outlet, which can result in a dynamic valve effect.

Figure 6A:
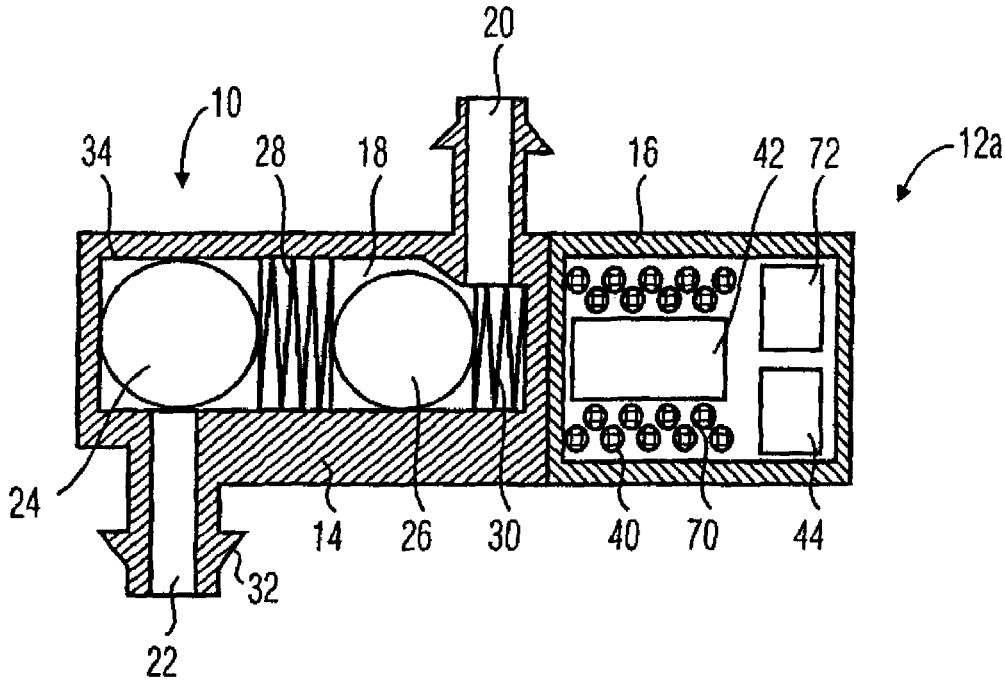
FIGS. 6*a* and 6*b* are schematic sectional views for illustrating a further embodiment of an inventive pump.
Figure 6B:
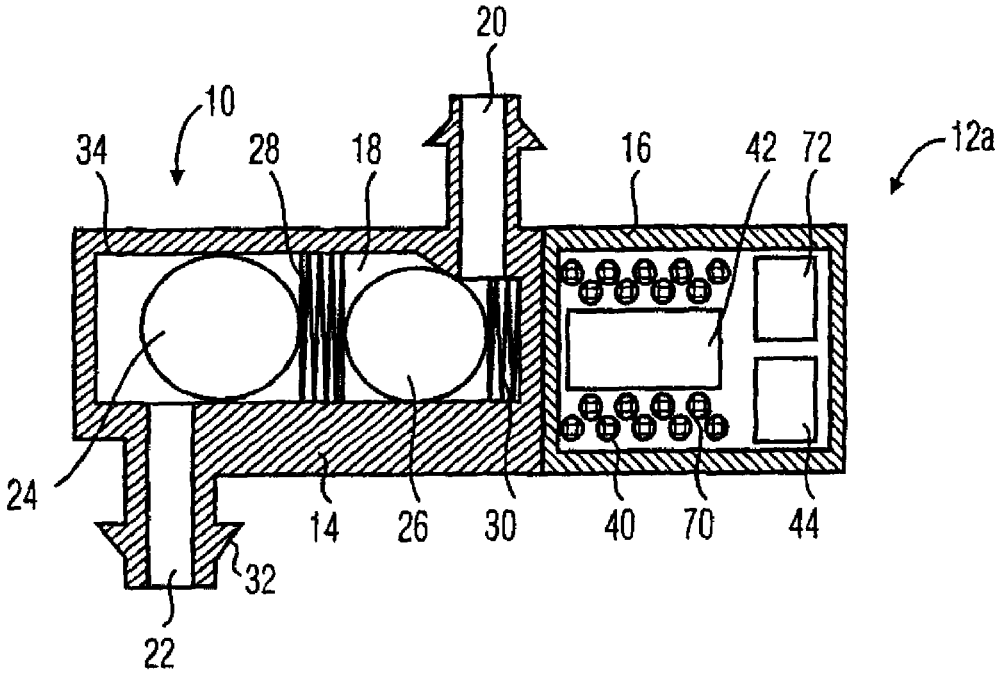

FIGS. 6*a* and 6*b* show a further embodiment of an inventive pump representing a modification of the embodiment shown in FIGS. 1*a* and 1*b*, wherein a discussion and description of the elements and functionality already described with reference to FIGS. 1*a* and 1*b* are omitted.

The pump element shown in FIGS. 6*a* and 6*b* fully corresponds to the one of the embodiment of FIGS. 1*a* and 1*b*, wherein FIG. 6*a* shows the two balls 24 and 26 in the idle state and FIG. 6*b* the two balls in the operated state. In the embodiment shown in FIGS. 6*a* and 6*b*, a driving unit 12*a* differs from the one described with reference to FIGS. 1*a* and 1*b* in that a sensing means for detecting a position of the balls is provided. This sensing means comprises a sensing coil 70 and a detection means 72. The detection means 72 can be integrated in the control means 44 or can be provided separate from the same. The detection means 72 is coupled to the sensing coil 70 and can further be coupled to the driving coil 40. Either the control means 44 or the detection means 72 are formed to send such an alternating current through the driving coil 40 that an alternating magnetic field, for example a magnetic alternating field is superposed, the change of which induces a voltage $U_{ind}$ in the sensing coil 70. Due to the permeability of the material of the balls 24 and 26, this voltage also changes in dependence on the position of the balls in the pump element. The detection means 72 is implemented to detect the voltage $U_{ind}$ and to evaluate changes of the same for drawing conclusions about the position of the balls in the pump element. Thus, the position of the balls 24 and 26 within the pump element 10 can be determined, so that the position and function of the pump element can be monitored. In such an embodiment, it is possible to amplify the measurement signal represented by the voltage induced in the coil 70 by a magnetic yoke and pole shoes positioned on the same.

Embodiments of assemblies allowing an increase of the effective magnetic forces or an increase of the measurement signal, respectively, will be discussed below in more detail with reference to FIG. 7 to 9.

Figure 7:
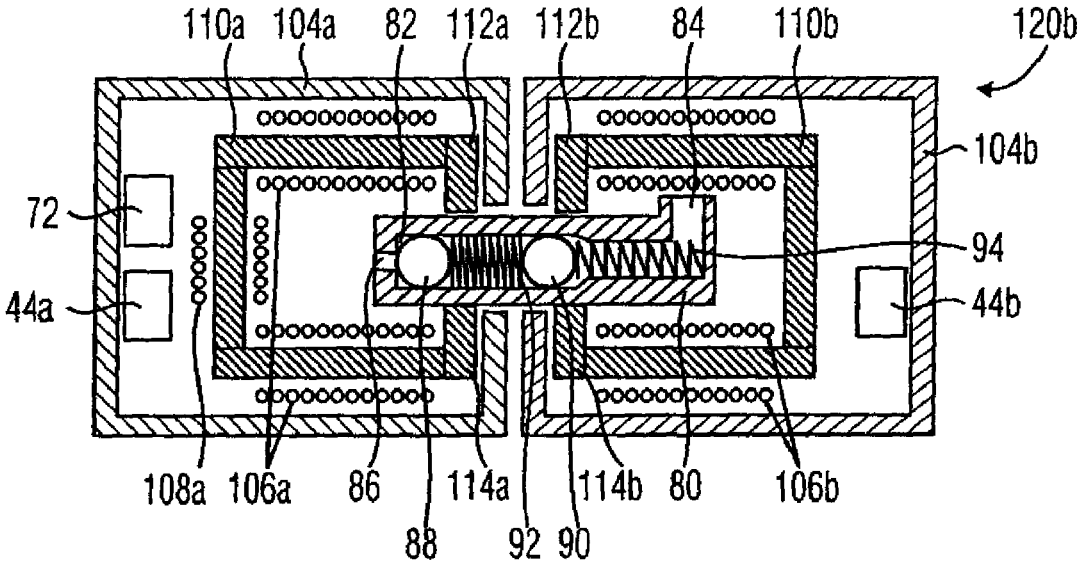
Figure 8:
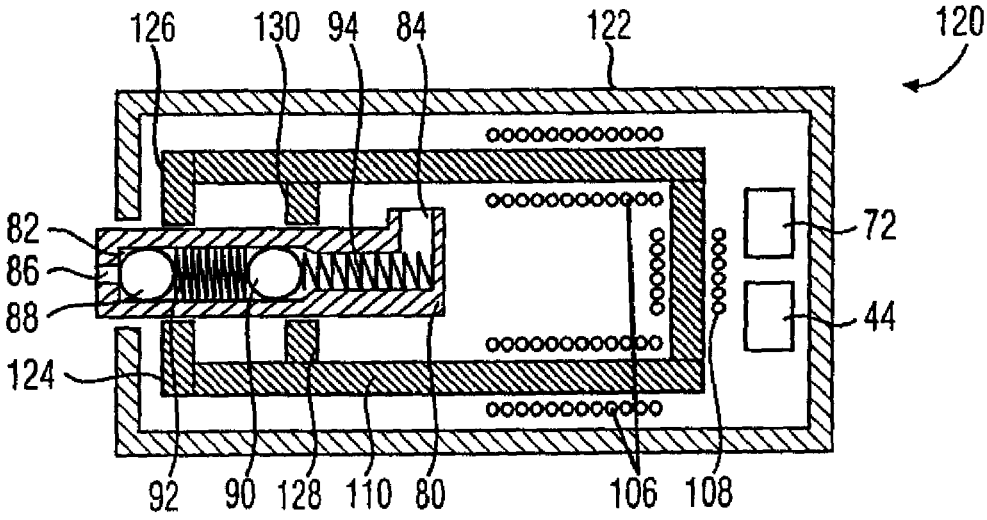

FIG. 7 to 8 each show a pump element having a pump element housing 80, wherein a pump chamber 82, an inlet 84 and an outlet 86 are formed. A first movable ball 88 and a second movable ball 90 are disposed in the pump chamber 82, which are biased to the shown positions by a first spring 92 and a second spring 94.

In the embodiment shown in FIG. 7, two separate driving units 102*a* and 102*b* are provided for the first ball 88 and the second ball 90. The driving units 102*a* and 102*b* can have a similar structure, wherein respective features of the driving unit 102*a* are indicated with the letter "a", while features of the driving unit 102*b* are indicated with the letter "b". The driving units have driving unit housing parts 104*a* and 104*b* that can be coupled to the pump element in a reversible manner. The driving unit 102*a* has one or several driving coils 106*a* and one or several sensing coils 108*a*. The driving unit 102*b* has one or several driving coils 106*b*. The driving unit 102*a* has a control means 44*a* and a detection means 72. The driving unit 102*b* also has a control means 44*b* and can further optionally have one or several sensing coils and a detection means.

As can be seen in FIG. 7, the driving coils 106*a* and 108*a* are wound around a ferromagnetic yoke 110*a*, and the driving coils 106*b* are wound around a ferromagnetic yoke 110*b*. Pole shoes 112*a* and 114*a* are attached to the ferromagnetic yoke 110*a*, which conduct the magnetic flow such that the ball 88 is pulled between the pole shoes 112*a* and 112*b* in the operated state. Also, pole shoes 112*b* and 114*b* are attached to the yoke 110*b*, which conduct the magnetic flow such that the ball 90 is pulled between the pole shoes 112*b* and 114*b* in the operated state.

By using yokes and pole shoes that can consist, for example, of a ferromagnetic material, the movable elements, in the shown embodiments balls 88 and 90, can become part of the magnetic circle, which can significantly increase the effective magnetic forces. Further, the measurement signal induced in the sensing coil 108*a* and detected by the detection means 72 can be significantly stronger.

The structural implementation of the yokes and pole shoes depends on the respective design of the pump element. Here, it should be noted, that the geometrical design of the pump elements shown in the embodiments is merely exemplarily for illustration purposes. Further, it should be noted, that the inlets and outlets can be arranged at any appropriate position, wherein in particular the position of the inlet in FIGS. 7 and 8 is purely schematically and is, of course, at an appropriate position for allowing a fluid, i.e. a liquid or a gas, to flow into the pump chamber.

The functionality of the embodiment shown in FIG. 7 can mainly correspond to the functionality of the embodiments described above with reference to FIGS. 1*a* and 1*b*. In this regard, the spring constants of the springs 92 and 94, that temporal control of impregnating a current into the driving coils 106*a* and 106*b* and/or the amount of the current impressed in the driving coils 106*a* and 106*b* (and the magnetic field generated thereby) can be adjusted, for effecting that the ball 90 closes the inlet 84 during operation, before the ball 88 is moved from the shown position to the operated position.

FIG. 8 shows a schematic view of an embodiment where a common driving unit is provided for the first ball 88 and the second ball 90. The driving unit 120 has a driving unit housing 122, which can again be reversibly coupled to the pump element. Further, the driving unit comprises a control means 44 and a detection means 72, which can be coupled to one or several driving coils 106 and one or several sensing coils 108, analogously to the above descriptions. The driving coil 106 and the sensing coil 108 are, as illustrated, wound around a yoke 110, which can consist of a ferromagnetic material. The yoke 110 has first pole shoes 124 and 126 for directing the magnetic flow for operating the first ball 88 and second pole shoes 128 and 130 for directing the magnetic flow for operating the second ball 90.

With regard to the functionality of the embodiment shown in FIG. 8, reference can be made to the above explanations with regard to FIGS. 1*a*, 1*b*, 6*a* and 6*b*, wherein again an increase of the magnetic force and the measurement signal can be obtained by the yoke 110 and the pole shoes attached to the same.

Figure 9:
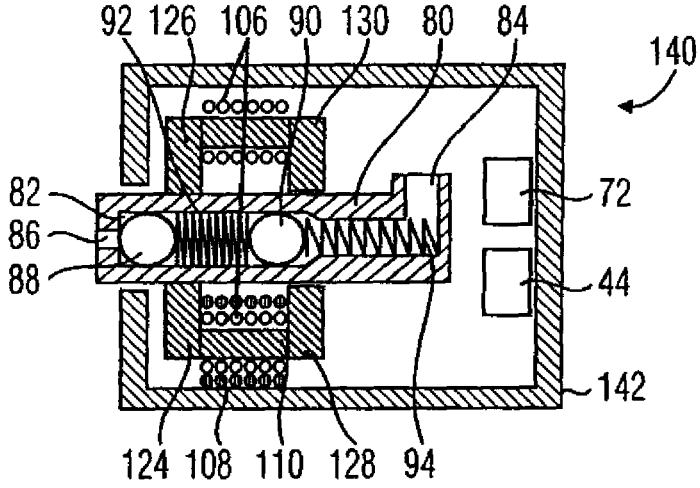
FIG. 7 to 9 are schematic sectional views of further embodiments of inventive pumps.

An alternative embodiment of a driving unit 140 for operating both balls 88 and 90 is shown in FIG. 9. The driving unit 140 comprises a driving unit housing 142, wherein again a control means 44, a detection means 73, one or several driving coils 106 and one or several sensing coils 108 are disposed. As can be seen in the embodiments shown in FIG. 9, in this embodiment, the driving coil 106 and the sensing coil 108 are provided on a yoke 144, which is disposed between pole shoes 124, 126, 128 and 130. Thus, the embodiment shown in FIG. 9 allows a very compact structure of the driving unit, which can again be coupled to the pump element housing in a reversible manner.

Figure 10:
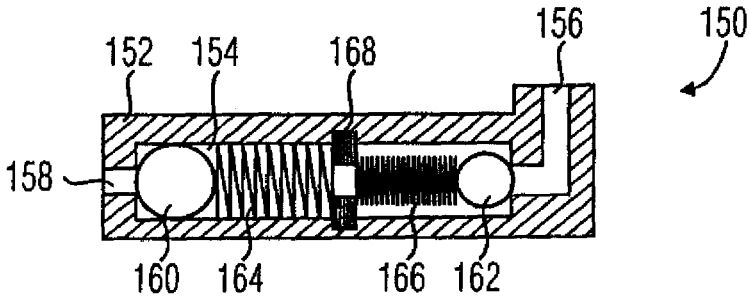
FIG. 10 is a schematic sectional view of an embodiment of an inventive pump element.

FIG. 10 shows a pump element 150 according to an alternative embodiment. The pump element 150 comprises a pump element housing 152, in which again a pump chamber 154, an inlet 156 and an outlet 158 are formed. Further, the pump element 150 has a first ball 160, a second ball 162, a first spring 164 and a second spring 166. A spring stop 168 is disposed between the springs. The springs 164 and 166 bias the balls 160 and 162 to the position shown in FIG. 10.

By using a respective driving unit (not shown), the ball 160 can be moved away from the outlet 158 against the force of the spring 164, for opening the same and for transporting a fluid past the ball, while the inlet 156 is closed by the ball 162. For realizing a respective driving unit, pole shoes can again be provided slightly displaced from the ball 160 in the direction of the inlet 156.

After turning-off of the magnetic force, the spring 164 drives the ball back to the position shown in FIG. 10, wherein fluid is driven out of the outlet 158. Together with the spring 166, the ball 162 forms a check valve, which allows reflow of fluid through the inlet 156. The spring 166, the ball 162, and the sealing seat on the inlet 156 can be matched to each other such that the check valve formed thereby immediately opens in pass direction, when the ball 160 is in the pumping movement towards the outlet 158, and immediately closes in blocking direction, when the ball 160 is in the charging movement away from the outlet 158.

Thus, in the embodiment shown in FIG. 10, the spring 164 forms the pump drive together with the ball 160, wherein the spring 164 and the sealing seat of ball 160 and pump housing 152 or the outlet 158 through the same, respectively, can be matched such that the outlet 158 is reliably sealed by the element 160, as long as the magnetic drive is turned off, i.e. as long as the system is in an idle state. By this structure, an idle flow from the inlet 156 through the outlet 158 can be effectively prevented, as well as a back flow from the outlet 158 back to the inlet 156.

In the embodiment according to FIG. 10, the springs 164 and 166 are decoupled and are supported by a fixed stop 168. The two spring forces are mainly determined from the distance between the ball 160 and the spring stop 168 or between the ball 162 and the spring stop 168, respectively, and are thus fully decoupled from each other.

For supporting the opening of the inlet 156 when the ball 160 is in the pumping movement towards the outlet 158, an additional magnetic drive could be provided for the ball 162, which can be controlled independent of the magnetic drive for the ball 160.

In summary, embodiments of the present invention provide a pump for fluids having a first housing and an inlet and an outlet and a second housing, which can be mechanically connected to the first housing in a detachable manner. The first housing can include a first moving element and at least a first spring, wherein the first spring defines the first movable element in a position sealing the outlet. The housing can include a second movable element and at least a second spring, wherein the second spring defines the second movable element in a position freeing the inlet. The second housing can include at least one coil, a ferromagnetic core and a control means, which serves for generating a magnetic field and thus the movable elements are defined in a second position opposing the effective force of the springs, wherein the inlet is sealed by the second movable element and the outlet is freed by the first movable element. After turning-off the magnetic force, the movable elements can be brought back to the idle position by the springs, so that fluid contained in the first housing is at least partly discharged from the outlet.

As described above, embodiments of the present invention comprise, two movable elements. In embodiments of the invention, both movable elements can be operated by a driving unit. In alternative embodiments, only the first movable element can be driven by a driving unit, while the other movable element can be effective as check valve and is substantially merely driven by fluid flowing in. As an alternative to such a check valve using a movable element, as has been described, for example, with reference to FIG. 10, the inlet could also be provided with a conventional check valve, for example a flap valve, which opens the inlet during the pumping movement of the first movable element and closes the inlet during the transport movement, where fluid is transported past the first movable element. As a further alternative, the inlet does not have to be provided with a valve at all, as long as the flow resistance from the first movable element through the inlet is higher than the flow resistance between the first movable element and the inner pump element housing wall, since in that case still a net pump effect through the outlet can be effected.

Advantageously, housing parts of the pump element housing can consist of plastic and can be produced, for example, by using injection-molding techniques. However, the housing parts can also be produced by using other suitable materials, for example by micro structuring techniques using semiconductor or ceramic materials or non-ferromagnetic metals. The movable element(s) can advantageously be implemented of a ferromagnetic, soft magnetic or permanent magnetic material.

In embodiments of present invention, the first movable element can be permanent magnetic and can be implemented as magnetic dipole, wherein the magnetic axis of the dipole is oriented such that the movable element performs a rotatory movement, in addition to the translatory movement, when applying an external magnetic field generated by a driving unit, wherein the first movable element is positioned in the pump element housing such that its fluidic effective geometry is altered in the sense of a valve, as has been discussed above with reference to FIG. 5.

Described embodiments of the present invention have movable elements, which have the shape of a ball or a piston. However, it is clear that the movable element(s) can have any shape that provides the described functionality in connection with a respective pump element housing.

As has been discussed with reference to FIG. 4, a further sealing element can be attached to the movable element, which can consist of elastic material and changes its fluidic effective geometry in dependence on the direction of movement of the movable element, wherein the movable element has a valve function in connection with the sealing element, with the help of which the ratio of the discharged amount of fluid to the amount of fluid flowing back through the flow path between movable element and pump element housing during the pumping movement can be increased.

In embodiments of the present invention, the springs biasing the first movable element in the position and/or the second movable element in the third position can consist of any suitable material, such as a nonmagnetic nonferrous metal. In embodiments of the invention, the driving unit is formed in a separate housing such that the same can be placed onto different pump element housings, so that several types of pumps can be controlled with one driving unit.

In embodiments of the present invention, the discharge rate of the pump can be adjusted during operation by changing the pump frequency or by varying the pump stroke of the first movable element. In embodiments of the present invention, the pump frequency can be adjusted by changing the frequency at which a current is impressed into the driving coil by the control means. In embodiments of the invention, the pump stroke of the first movable element can be varied by changing the impressed current and thus changing the generated magnetic force. According to embodiments of the present invention, the discharge rate can further be adjusted by varying the gap between the first movable element and pump element housing as well as varying the spring bias $F_{vor}$, for example in advance during the design of the pump.

In embodiments of the present invention, a defined amount of fluid is pumped per pump stroke. For obtaining a desired amount of dosage, a respectively necessitated number of pump strokes can be counted and performed. As has been described above with reference to FIG. 7 to 9, the magnetic flow can be specifically directed into the movable element(s) via a ferromagnetic yoke and ferromagnetic pole shoes mounted thereon. Above that, the magnetic flow through the balls can be specifically adjusted by varying the cross section of the pump housing in the movement areas of the movable elements.

In embodiments of the present invention, a magnetic drive can be implemented of two substantially identical units, wherein every unit has its own control means and is thus able to control a respective one of the movable elements individually. In alternative embodiments, the magnetic drive can consist of a unit, wherein a magnetic flow is passed into both movable elements simultaneously via a ferromagnetic yoke and pole shoes. In other alternative embodiments, the magnetic drive can consist of one unit, wherein a ferromagnetic yoke is implemented in two parts with pole shoes mounted thereon, wherein the driving coils are mounted on the yoke in the area between the two movable elements.

Finally, as has been described above with reference to FIGS. 6*a* and 6*b*, in embodiments of the present invention, the second housing comprising the driving unit can have a further coil and a detection means, wherein a magnetic alternating field is superposed on the driving coil, which induces a voltage in the further coil, which is measured and evaluated by the detection means, wherein the induced voltage in the further coil depends on the position of the movable elements in the pump element housing, and wherein the detection means can determine the position of the movable elements and thus the position and function of the pump.

While in the described embodiments the first movable element closes the outlet when the same is in the first position, in alternative embodiments, the outlet might not be completely closed when the first movable element is in the first position, wherein still a net pump effect can be obtained.

Apart from the described magnetic drives, in alternative embodiments, other drives can be used for the movable elements, such as electrostatic drives or pneumatic drives.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A pump element comprising:

a pump element housing defining a pump chamber;

an inlet into the pump chamber;

an outlet from the pump chamber;

a first movable element movable in the pump chamber between a first and a second position, wherein during a movement of the first movable element in the direction from the first to the second position, a flow resistance of a flow path from the first movable element through the inlet is higher than a flow resistance of a flow path between the pump element housing and the first movable element, and wherein during a movement of the first movable element in the direction from the second position to the first position, a flow resistance of a flow path from the first movable element through the outlet is smaller than a flow resistance of the flow path between the pump element housing and the first movable element, so that a net flow through the outlet takes place during a reciprocating movement of the first movable element between the first and the second position, wherein the first movable element closes the outlet when the same is in the first position.

2. The pump element according to claim 1, further comprising a second movable element, by which the flow resistance of the flow path from the first movable element through the inlet can be varied.

3. The pump element according to claim 2, wherein the pump chamber housing contributes to a determination of a path for a movement of the second movable element from a third position to a fourth position, wherein, when the second movable element is in the third position, the flow resistance of the flow path of the first movable element through the inlet is smaller than when the second movable element is in the fourth position.

4. The pump element according to claim 1, wherein the flow resistance of the flow path between the pump element housing and the first movable element during the movement of the first movable element in the direction from the first to the second position is smaller than during the movement of the first movable element from the second to the first position.

5. The pump element according to claim 4, wherein the first movable element comprises a first position and a second position, wherein the flow resistance of the flow path between the pump element housing and the first movable element in the first position is smaller than in the second position.

6. The pump element according to claim 4, wherein the first movable element comprises a flexible sealing element, which provides a first flexibility during the movement from the first position to the second position, and a second flexibility during the movement from the second position to the first position, which is lower than the first flexibility.

7. A pump element comprising:

a pump element housing defining a pump chamber comprising an inlet and an outlet;

a first movable element movable in the pump chamber between a first position and a second position, wherein the outlet is closed when the first movable element is in the first position;

a second movable element movable in the pump chamber between a third and a fourth position;

a first spring biasing the first movable element to the first position;

a second spring biasing the second movable element to the third position;

wherein a net flow through the outlet takes place during a reciprocating movement of the first movable element between the first and the second position and the second movable element between the third and the fourth position.

8. The pump element according to claim 7, wherein the first and the second spring are disposed between the first and the second movable element, and wherein a spring stop is disposed between the first and the second spring, wherein the inlet is closed when the second movable element is in the third position, and wherein the inlet is open when the second movable element is in the fourth position.

9. A pump comprising a pump element, the pump element comprising:

a pump element housing defining a pump chamber;

an inlet into the pump chamber;

an outlet from the pump chamber;

a first movable element movable in the pump chamber between a first and a second position, wherein during a movement of the first movable element in the direction from the first to the second position, a flow resistance of a flow path from the first movable element through the inlet is higher than a flow resistance of a flow path between the pump element housing and the first movable element, and wherein during a movement of the first movable element in the direction from the second position to the first position, a flow resistance of a flow path from the first movable element through the outlet is smaller than a flow resistance of the flow path between the pump element housing and the first movable element, so that a net flow through the outlet takes place during a reciprocating movement of the first movable element between the first and the second position, wherein the first movable element closes the outlet when the same is in the first position; and a driving unit, which is implemented to drive the first movable element from the first into the second position and/or to drive the second movable element from the third into the fourth position.

10. The pump according to claim 9, wherein the driving unit and the pump element are separately structured and can be coupled to each other in a reversible manner, wherein the driving unit and the pump element are implemented such that, during pumping, the driving unit does not come in contact with fluid to be pumped.

11. The pump according to claim 9, wherein the driving unit comprises a device for generating a magnetic field by which the first movable element is driven into the second position and/or the second movable element is driven into the fourth position, and wherein the first and/or second movable element comprise a ferromagnetic, soft-magnetic or permanent-magnetic material.

12. The pump according to claim 11, wherein the device for generating a magnetic field comprises a first device for generating a magnetic field, by which the first movable element is driven into the second position, and a second device for generating a magnetic field, by which the second movable element is driven into the fourth position, wherein the first and the second device for generating a magnetic field can be controlled separately.

13. The pump according to claim 9, further comprising a device for detecting the position of the first and/or the second movable element.

14. A method for adjusting the discharge rate of a pump comprising a pump element, the pump element comprising:

a pump element housing defining a pump chamber;

an inlet into the pump chamber;

an outlet from the pump chamber;

a first movable element movable in the pump chamber between a first and a second position, wherein during a movement of the first movable element in the direction from the first to the second position, a flow resistance of a flow path from the first movable element through the inlet is higher than a flow resistance of a flow path between the pump element housing and the first movable element, and wherein during a movement of the first movable element in the direction from the second position to the first position, a flow resistance of a flow path from the first movable element through the outlet is smaller than a flow resistance of the flow path between the pump element housing and the first movable element, so that a net flow through the outlet takes place during a reciprocating movement of the first movable element between the first and the second position, wherein the first movable element closes the outlet when the same is in the first position; and a driving unit, which is implemented to drive the first movable element from the first into the second position and/or to drive the second movable element from the third into the fourth position, the method comprising:

adjusting a frequency at which the first and, if present, the second movable element are moved back and forth;

adjusting the stroke of the movement of the first movable element between the first and the second position;

adjusting the flow resistance of the flow path between the first movable element and the pump element housing; and changing a spring bias biasing the first movable element to the first position and/or a spring bias biasing the second movable element to the third position.

15. A method for operating a pump comprising a pump element, the pump element comprising:

a pump element housing defining a pump chamber;

an inlet into the pump chamber;

an outlet from the pump chamber;

a first movable element movable in the pump chamber between a first and a second position, wherein during a movement of the first movable element in the direction from the first to the second position, a flow resistance of a flow path from the first movable element through the inlet is higher than a flow resistance of a flow path between the pump element housing and the first movable element, and wherein during a movement of the first movable element in the direction from the second position to the first position, a flow resistance of a flow path from the first movable element through the outlet is smaller than a flow resistance of the flow path between the pump element housing and the first movable element, so that a net flow through the outlet takes place during a reciprocating movement of the first movable element between the first and the second position, wherein the first movable element closes the outlet when the same is in the first position; and a driving unit, which is implemented to drive the first movable element from the first into the second position and/or to drive the second movable element from the third into the fourth position, wherein during a reciprocating movement of the movable element a known amount of fluid is discharged from the outlet, wherein a number of reciprocating movements of the first movable element is counted for outputting a defined amount of dosage through the outlet.

* * * * *